US010215465B2

(12) United States Patent
Zhang et al.

(10) Patent No.: US 10,215,465 B2
(45) Date of Patent: Feb. 26, 2019

(54) SYSTEMS AND METHODS FOR LOW LOAD COMPRESSOR OPERATIONS

(71) Applicant: HEATCRAFT REFRIGERATION PRODUCTS LLC, Richardson, TX (US)

(72) Inventors: Zhi Zhang, Jiangsu (CN); Yang Xie, Jiangsu (CN); Hongxiang Chen, Jiangsu (CN)

(73) Assignee: Heatcraft Refrigeration Products LLC, Richardson, TX (US)

( * ) Notice: Subject to any disclaimer, the term of this patent is extended or adjusted under 35 U.S.C. 154(b) by 425 days.

(21) Appl. No.: 14/927,543

(22) Filed: Oct. 30, 2015

(65) Prior Publication Data

US 2017/0122635 A1 May 4, 2017

(51) Int. Cl.

| | |
|---|---|
| ***F25B 5/02*** | (2006.01) |
| ***F25B 31/00*** | (2006.01) |
| ***F25B 40/04*** | (2006.01) |
| ***F25B 41/04*** | (2006.01) |
| ***F25B 49/02*** | (2006.01) |

(52) U.S. Cl.

CPC ..... *F25B 49/022* (2013.01); *F25B 5/02* (2013.01); *F25B 31/004* (2013.01); *F25B 40/04* (2013.01); *F25B 41/04* (2013.01); *F25B 49/02* (2013.01); *F25B 2400/0401* (2013.01); *F25B 2400/0403* (2013.01); *F25B 2400/0409* (2013.01); *F25B 2400/0413* (2013.01); *F25B 2400/16* (2013.01); *F25B 2600/2501* (2013.01); *F25B 2700/1933* (2013.01)

(58) Field of Classification Search

CPC ..... F25B 2600/2501; F25B 31/004; F25B 2400/0403; F25B 47/02

See application file for complete search history.

(56) References Cited

U.S. PATENT DOCUMENTS

| | | | | |
|---|---|---|---|---|
| 9,145,880 | B2 | 9/2015 | Ellis | |
| 2002/0053218 | A1* | 5/2002 | Wightman | F25B 41/04 62/513 |
| 2009/0025407 | A1* | 1/2009 | Dalla Valle | B01D 53/265 62/129 |
| 2010/0281894 | A1* | 11/2010 | Huff | F25B 9/008 62/115 |
| 2012/0011866 | A1 | 1/2012 | Scarcella et al. | |
| 2012/0198868 | A1 | 8/2012 | Huff et al. | |
| 2014/0151015 | A1 | 1/2014 | Sun et al. | |

FOREIGN PATENT DOCUMENTS

| | | |
|---|---|---|
| CN | 202734366 U | 2/2013 |
| CN | 204084713 U | 1/2015 |

* cited by examiner

*Primary Examiner* — Cassey D Bauer
(74) *Attorney, Agent, or Firm* — Winstead PC

(57) ABSTRACT

The present application provides a low load operating system for a refrigeration system having a compressor, a condenser, an expansion valve, and an evaporator. The low load operating system may include a hot gas bypass line extending from a discharge side of the compressor to a suction side of the compressor and a desuperheat line extending from upstream of the expansion valve to the suction side of the compressor.

20 Claims, 3 Drawing Sheets

SYSTEMS AND METHODS FOR LOW LOAD COMPRESSOR OPERATIONS

TECHNICAL FIELD

The present application and the resultant patent relate generally to refrigeration systems and more particularly relate to systems and methods for operating a compressor rack in a refrigeration system at low load conditions for an extended period of time.

BACKGROUND OF THE INVENTION

Modern air conditioning and refrigeration systems provide cooling, ventilation, and humidity control for all or part of a climate controlled area such as a refrigerator, a cooler, a building, and the like. Generally described, a conventional refrigeration cycle includes four basic stages to provide cooling. First, a vapor refrigerant is compressed within one or more compressors at high pressure and high temperature. Second, the compressed vapor is cooled and condensed within a condenser by heat exchange with ambient air drawn or blown against a condenser coil. Third, the liquid refrigerant is passed through an expansion device that reduces both the pressure and the temperature. The liquid refrigerant is then pumped to one or more evaporators within the climate controlled area. The liquid refrigerant absorbs heat from the surrounding area in an evaporator coil and evaporates to a vapor. Finally, the vapor refrigerant returns to the compressor and the cycle repeats. Several alternatives to this basic refrigeration cycle are known and also may be used herein.

When the load on the overall refrigeration system is low, the compressor racks may be unloaded to match the low load. If the load, however, is lower than the minimum capacity output of the compressor rack, then the compressors may stop and start frequently. Such frequent action may cause damage to the compressors as well as disrupt the overall system oil return.

SUMMARY OF THE INVENTION

The present application and the resultant patent thus provide a low load operating system for a refrigeration system having a compressor, a condenser, an expansion valve, and an evaporator. The low load operating system may include a hot gas bypass line extending from a discharge side of the compressor to a suction side of the compressor and a desuperheat line extending from upstream of the expansion valve to the suction side of the compressor.

The present application and the resultant patent further provide a method of operating a compressor in low load conditions. The method may include the steps of monitoring the compressor, determining if the low load conditions are present on the compressor, opening a hot gas bypass line to the compressor, opening a desuperheat line to the compressor, and periodically opening an oil return line. The valves then may be closed and the steps repeated.

The present application and the resultant patent further provide a refrigeration system. The refrigeration system may include a compressor rack, a hot gas bypass line extending from a discharge side of the compressor rack to a suction side of the compressor rack, a condenser, an expansion valve, a desuperheat line extending from upstream of the expansion valve to the suction side of the compressor rack, and an evaporator.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
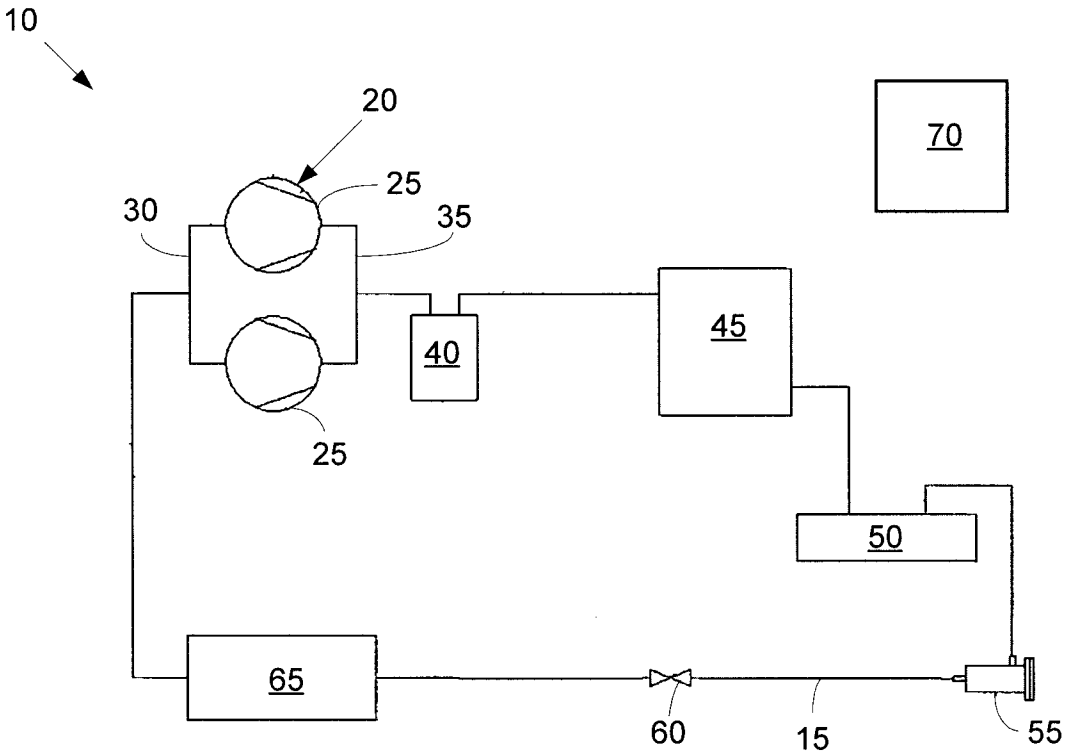
FIG. 1 is a schematic diagram of a known refrigeration system with a number of compressors, a condenser, an expansion valve, an evaporator, and other components.

Referring now to the drawings, in which like numerals refer to like elements throughout the several views, FIG. 1 shows an example of a known refrigeration system 10. The refrigeration system 10 may be used to cool any type of a climate controlled area or a refrigerated space. The refrigerated space may be a refrigerator, a cooler, a freezer, a building, and the like. The refrigeration system 10 may include a flow of a refrigerant 15. The refrigerant 15 may include conventional refrigerants such as hydroflurocarbons, carbon dioxide, ammonia, and the like. Any type of refrigerant 15 may be used herein.

The refrigeration system 10 may include one or more compressor racks 20. Each compressor rack 20 may include any number of compressors 25 thereon. The compressors 25 may be of conventional design and may have any suitable size, shape, configuration, or capacity. The compressor racks 20 and/or the compressors 25 may be arranged in a parallel configuration or a series configuration. The compressor rack 20 and each of the compressors 25 may include a suction side 30 and a discharge side 35. The compressors 25 may accept the flow of refrigerant 15 at the suction side, compress the flow therein, and discharge the flow on the discharge side 35. An oil separator 40 and the like may be positioned downstream of the discharge side 35. The oil separator 40 may separate a flow of oil in the refrigerant 15 due to compression within the compressors 25.

The refrigeration system 10 may include a condenser 45 positioned downstream of the compressor racks 20. The condenser 45 may be of conventional design and may have any suitable size, shape, configuration, or capacity. The condenser 45 may pull in ambient air for heat exchange with the refrigerant 15. The now liquid refrigerant 15 then may be stored in a receiver 50 and the like. A filter 55 and other components may be positioned downstream of the receiver 50. The receiver 50 and the filter 55 may be of conventional design.

The refrigeration system 10 may include an expansion valve 60. The expansion valve 60 may be positioned downstream of the receiver 50. The expansion valve 60 may reduce the pressure and the temperature of the flow of refrigerant 15 therethrough. The expansion valve 60 may be of conventional design and may have any suitable size, shape, configuration, or capacity.

The refrigeration system 10 may include one or more evaporators 65 positioned downstream of the expansion valve 60. The evaporators 65 may be positioned within or adjacent to the refrigerated space for heat exchange therewith. The evaporators 65 may be of conventional design and may have any suitable size, shape, configuration, or capacity. The refrigerant 15 then may return to the compressor racks 20 so as to repeat the cycle. Other components and other configurations may be used herein.

Operation of the refrigeration system 10 and components thereof may be controlled and monitored by a controller 70. The controller 70 may be any type of programmable logic device and the like. More than one controller 70 may be used herein. The controller 70 may be local or remote. The refrigeration system 10 and the components described herein are for the purpose of example only. Many other types of refrigeration systems, refrigeration cycles, and refrigeration components may be known and used herein.

Figure 2:
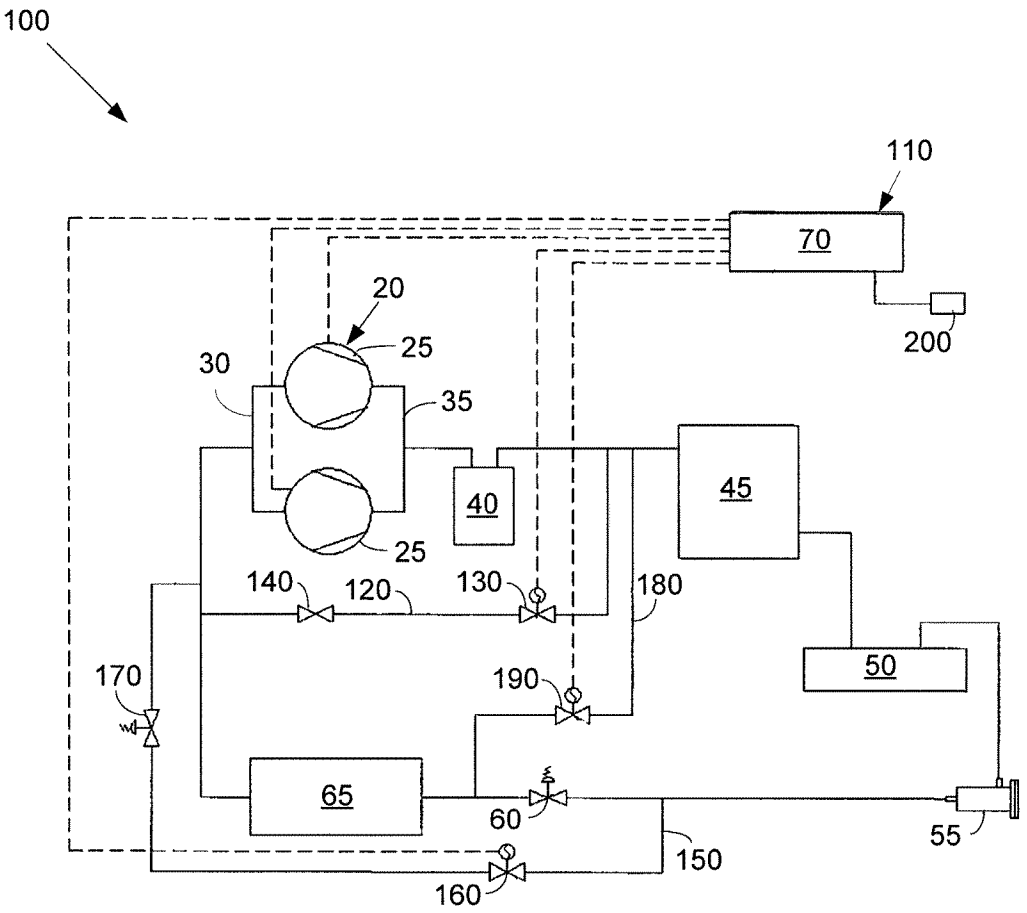
FIG. 2 is a schematic diagram of a refrigeration system with a low load operating system as may be described herein.

FIG. 2 shows an example of a refrigeration system 100 as may be described herein. The refrigeration system 100 may be used to cool any type of a climate controlled area or a refrigerated space. The overall refrigeration system 100 and the components thereof may have any suitable size, shape, or configuration, or capacity. Heating applications also may be used herein. The refrigeration system 100 and the components thereof may be substantially similar to those described about unless otherwise noted.

The refrigeration system 100 may include a low load operating system 110. The low load operating system 110 may include a hot gas bypass line 120. The hot gas bypass line 120 may extend from downstream of the discharge side 35 of the compressors 25 to upstream of the suction side 30 of the compressors 25. The hot gas bypass line 120 may include a hot gas bypass line solenoid valve 130 and a hot gas bypass line flow valve 140. The hot gas bypass line solenoid valve 130 may be any type of on/off valve. The hot gas bypass line solenoid valve 130 may be in communication with the controller 70 and the like. The hot gas bypass line flow valve 140 may be any type of valve that controls the flow of the refrigerant 15 therethrough. The hot gas bypass line flow valve 140 also may be manually operated together with the solenoid valve 130. Other components and other configurations may be used herein.

The low load operating system 110 also may include a desuperheat line 150. The desuperheat line 150 may extend from upstream of the expansion valve 60 to upstream of the suction side 30 of the compressors 25 so as to bypass the evaporator 65. The desuperheat line 150 may include a desuperheat line solenoid valve 160 and a desuperheat line flow valve 170. As described above, the desuperheat line solenoid valve 160 may be any type of on/off valve. The desuperheat line solenoid valve 160 may be in communication with the controller 70. The desuperheat line flow valve 170 may be any type of valve that controls the flow of the refrigerant 15 therethrough. The desuperheat line flow valve 170 also may be manually operated together with the solenoid valve 160. Other components and other configurations may be used herein.

The low load operating system 110 may include an oil return line 180. The oil return line 180 extends from downstream of the oil separator 40 to upstream of the evaporator 65. An oil return line solenoid valve 190 may be positioned thereon. The solenoid valve 190 may be any type of on/off valve. The solenoid valve 190 may be in communication with the controller 70. Other components and other configurations may be used herein.

The low load operating system 110 may include one or more pressure sensors 200. The pressure sensors 200 may be in communication with the suction side 30 of the compressors 25 and the controller 70. The pressure sensors 200 may be of conventional design. Other types of sensors and other positions also may be used herein. Other components and other configurations may be used herein.

Figure 3:
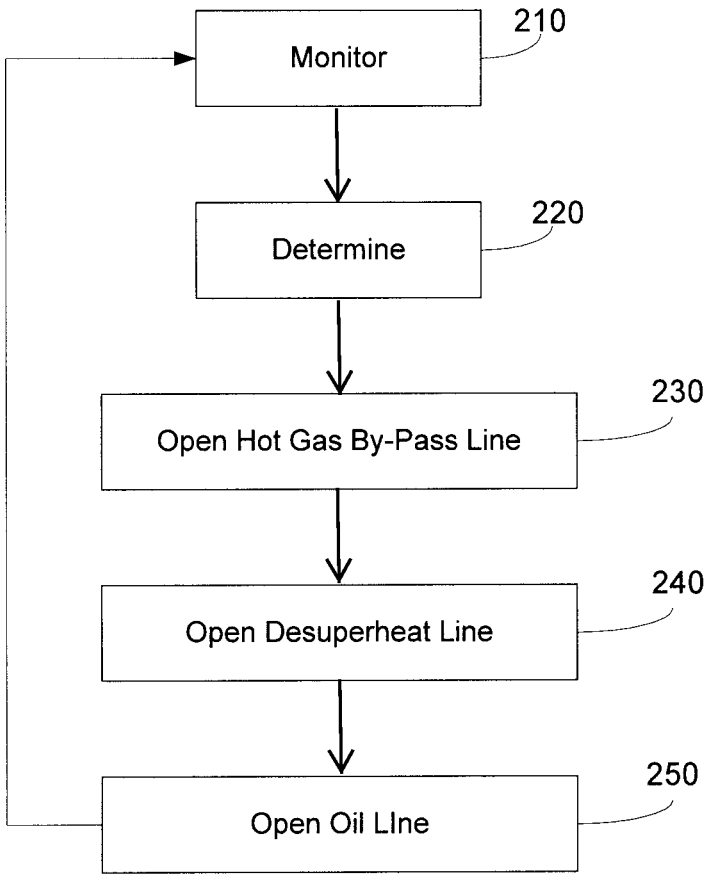
FIG. 3 is a flow chart of exemplary steps that may be taken with the low load operating system.

FIG. 3 is a flow chart that shows the refrigeration system 100 with the low load operating system 110 in use. At step 210, the controller 70 monitors the operation of the compressor racks 20. The controller 70 may consider any type of operational parameter with respect to the compressor racks 20. Such parameters may include the running time of the compressor rack 20; the percentage of time that only one of the compressors 25 is running in a cycle; the start/stop times of the compressors 25 in one cycle; the suction pressure variation range and ratio based upon the pressure sensor 200; and similar parameters and combinations thereof. At step 220, the controller 70 may determine that low load conditions are present such that only one of the compressors 25 will be cycled. At step 230, the hot gas bypass line 120 may be opened. Specifically, the hot gas bypass line solenoid valve 130 may be opened by the controller 70 such that a flow of refrigerant 15 may flow through the hot gas bypass line flow valve 140 so as to increase the suction pressure at the suction side 30 of the compressor 25. This increased pressure may assist in avoiding frequent compressor starts and stops. At step 240, the desuperheat line 150 may be opened. Specifically, the desuperheat line solenoid valve 160 may be opened such that the refrigerant 15 may flow through the desuperheat line 150 and the desuperheat line flow valve 170 so as to maintain the proper superheat on the suction side 30 of the compressors 25. At step 250, the oil return line 180 may be periodically opened so as to force the flow of oil back to the evaporators 65. Specifically, the controller 70 may open the oil return line solenoid valve 190. The low load operating system 110 then may the return to the monitoring step 210 to determine if low load conditions are still present and/or if the compressors 25 such be turned off. Alternatively, the low load operating system 110 may be manually operated in whole or in part. Specifically, one or more of the compressors 25 may be cycled and the various valves may be opened and closed as desired. Other components and other configurations may be used herein.

The refrigeration system 100 with the low load operating system 110 thus may avoid frequent starts and stops of the compressors 25 during low load operations. Likewise, the low load operating system 110 provides for oil return during these conditions. The low load operating system 110 thus may extend the useful lifetime of the refrigeration system 100 and the components thereof, particularly the compressors 25 and related components.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A low load operating system for a refrigeration system having a compressor, a condenser, an expansion valve, and an evaporator, comprising:

a hot gas bypass line, wherein the hot gas bypass line extends from a discharge side of the compressor to a suction side of the compressor;

a desuperheat line, wherein the desuperheat line bypasses the evaporator via extension from upstream of the expansion valve to the suction side of the compressor;

a controller, wherein the controller is operationally configured to determine existence of a low load condition and as a result of the low load condition opens a valve in the hot gas bypass line and in the desuperheat line to induce the flow of a refrigerant therethrough, whereby frequent compressor stops and starts are avoided and proper superheat conditions are maintained on the compressor; and an oil return line communicatively coupled to the system via the controller and functionally disposed downstream the hot gas bypass line and downstream of an oil separator and upstream of the condenser and further coupled upstream the evaporator and downstream a receiver.

2. The low load operating system of claim 1, wherein the hot gas bypass line comprises a hot gas bypass line solenoid valve.

3. The low load operating system of claim 1, wherein the hot gas bypass line comprises a hot gas bypass line flow valve.

4. The low load operating system of claim 1, wherein the desuperheat line comprises a desuperheat line solenoid valve.

5. The low load operating system of claim 1, wherein the desuperheat line comprises a desuperheat line flow valve.

6. The low load operating system of claim 1, wherein the oil return line comprises an oil return line solenoid valve.

7. The low load operating system of claim 1, further comprising a sensor in communication with the controller.

8. The low load operating system of claim 7, wherein the sensor comprises a pressure sensor positioned on the suction side of the compressor.

9. The low load operating system of claim 1, further comprising a plurality of compressors.

10. The low load operating system of claim 9, wherein the plurality of compressors comprises a compressor rack.

11. The low load operating system of claim 9, wherein the plurality of compressors comprises a parallel configuration.

12. A method of operating a compressor in a low load operating system with low load conditions, comprising:

monitoring the compressor;

determining, via a controller, if low load conditions are present;

in response to the controller's determination of the presence of low load conditions, opening a valve in a hot gas bypass line to induce the flow of a refrigerant therethrough;

in further response to the controller's determination of the presence of the low load conditions, opening a valve in a desuperheat line to induce the flow of a refrigerant therethrough to maintain superheat on the compressor, wherein the desuperheat line extends from upstream of an expansion valve to a suction side of the compressor and bypasses an evaporator;

opening an oil return line, wherein the oil return line is communicatively coupled to the system via the controller and functionally disposed downstream the hot gas bypass line and downstream of an oil separator and upstream of a condenser and further coupled upstream the evaporator and downstream a receiver; and whereby frequent compressor stops and starts are avoided.

13. The method of claim 12, wherein the hot gas bypass line comprises a hot gas bypass line solenoid valve and a hot gas bypass line flow valve.

14. The method of claim 12, wherein the desuperheat line comprises a desuperheat line solenoid valve and a desuperheat line flow valve.

15. The method of claim 12, wherein the oil return line comprises an oil return line solenoid valve.

16. The method of claim 12, further comprising a plurality of compressors.

17. The method of claim 16, wherein the plurality of compressors comprises a parallel configuration.

18. The method of claim 16, wherein the plurality of compressors comprises a compressor rack.

19. The method of claim 12, wherein at least one sensor is in communication with the controller.

20. The method of claim 19, wherein, wherein the sensor comprises a pressure sensor positioned on the suction side of the compressor.

* * * * *